US006495967B2

(12) United States Patent
Kao et al.

(10) Patent No.: US 6,495,967 B2
(45) Date of Patent: Dec. 17, 2002

(54) DISCHARGE CELLS BETWEEN BARRIER WALLS OF ALTERNATING CURRENT DISCHARGE TYPE PLASMA DISPLAY PANEL

(75) Inventors: Shiuh-Bin Kao, Taipei (TW); Yi-Sheng Yu, Taipei (TW); Ching-Hui Lin, Taipei (TW); Kuang-Lang Chen, Taipei (TW); Sheng-Chi Lee, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 0 days.

(21) Appl. No.: 09/870,786

(22) Filed: Jun. 1, 2001

(65) Prior Publication Data

US 2002/0145390 A1 Oct. 10, 2002

(30) Foreign Application Priority Data

Apr. 6, 2001 (TW) ..... 090108269 A

(51) Int. Cl.[7] ..... G09G 3/10

(52) U.S. Cl. ..... 315/169.4; 315/169.1; 313/585; 313/584

(58) Field of Search ..... 315/169.1, 169.3, 315/169.4; 313/505, 584, 585; 345/55, 76

(56) References Cited

U.S. PATENT DOCUMENTS 5,150,007 A * 9/1992 Andreadakis ..... 313/586
6,373,195 B1 * 4/2002 Whang et al. ..... 315/169.3

FOREIGN PATENT DOCUMENTS

JP 2000011894 A * 1/2000 ..... H01J/11/02

* cited by examiner

*Primary Examiner*—Don Wong
*Assistant Examiner*—Jimmy T Vu
(74) *Attorney, Agent, or Firm*—Bacon & Thomas

(57) ABSTRACT

In an alternating current discharge type plasma display panel (PDP) a plurality of parallel barrier walls are formed on a top surface of a back substrate of the PDP and barrier walls are disposed corresponding to cross-points of X electrodes and Y electrodes on a front substrate of the PDP. A structure includes a plurality of discharge cells between the adjacent barrier walls having smaller width corresponding to the X and Y electrodes for forming a large first space, a plurality of non-discharge cells each between the adjacent discharge cells for forming a small second space served as a gas channel between the adjacent discharge cells, and a junction between one discharge cell and the adjacent non-discharge cell, such that energy released from a gas discharge in the discharge cells is concentrated within the discharge cells for increasing discharge efficiency.

11 Claims, 10 Drawing Sheets

DISCHARGE CELLS BETWEEN BARRIER WALLS OF ALTERNATING CURRENT DISCHARGE TYPE PLASMA DISPLAY PANEL

FIELD OF THE INVENTION

The present invention relates to plasma display panels (PDPs) and more particularly to a structure of discharge cells between barrier walls of alternating current discharge type PDPs with improved characteristics.

BACKGROUND OF THE INVENTION

A manufacturing process of a conventional alternating current discharge type plasma display panel (PDP) 10 is shown in FIG. 1. First, two different activation layers are formed on glass substrates 11 and 12 respectively. Then the peripheries of substrates are sealed. A mixed gas consisting of helium (He), neon (Ne), and xenon (Xe) (or argon (Ar)) having a predetermined mixing volume ratio is stored in a discharge space therein. A front substrate 11 is defined as one that faces viewers. A plurality of parallel transparent electrodes 111, a plurality of bus electrodes 112, a dielectric layer 13, and a protective layer 14 are formed from the front substrate 11 inwardly. Correspondingly, from rear substrate 12 inwardly, a plurality of parallel data electrodes 121, a dielectric layer 124, a plurality of parallel spacer walls 122, and a uniform phosphor layer 123 are formed. When a voltage is applied on electrodes 111, 112, and 121, dielectric layers 113 and 124 will discharge to discharge cell 13 formed by adjacent barrier walls 122. As a result, a ray having a desired color is emitted from phosphor layer 123.

Conventionally, in PDP 10, a plurality of parallel transparent electrodes 111 are formed on an inner surface of front substrate 11 by sputtering and photolithography. (or printing). Then a plurality of bus electrodes 112 are formed on the transparent electrodes 111 by plating (or sputtering) and photolithography. The line impedance of the transparent electrodes 111 may be reduced by the provision of bus electrodes 112. In the following description, two adjacent transparent electrodes 111 (including bus electrodes 112) on the front substrate 11 are represented by an X electrode and a Y electrode respectively. A triple electrode is formed by the X electrode, Y electrode and corresponding data electrode 121 on the rear substrate 12. When a voltage is applied on the triple electrode, dielectric layers 113 and 124 will discharge to discharge cell 13 formed by adjacent spacer walls 122. Hence, UV rays are emitted from the mixed gas stored therein. And in turn, phosphor layer 123 in discharge cell 13 is excited by the UV rays. As an end, visible light is generated by the red, green and blue phosphor layers, resulting in appearance of an image.

As shown in FIGS. 1 and 2, a plurality of parallel barrier walls 122 are provided on back substrate 12. A plurality of parallel data electrodes 121 are provided on the underside of dielectric layer 124. Barrier walls 122 and data electrodes 121 alternate, with barrier walls 122 being positioned between data electrodes 121. A discharge cell 13 is formed between two adjacent barrier walls 122. A phosphor layer 123 is coated on discharge cell 13, opposite walls of barrier wall 122, and dielectric layer 124 respectively. However, several drawbacks have been found as detailed below (a) The coating area of phosphor layer 123 is small: In view of back substrate 12, phosphor layer 123 is only allowed to be coated on discharge cell 13, opposite-walls of barrier wall 122, and dielectric layer 124 respectively. This may lower the emissivity of PDP 10.

(b) Discharge area is small: Referring to FIG. 3, there is shown a sectional view of adjacent discharge cells 13 with a suitable distance D formed therebetween in the conventional alternating current type PDP 10. Such distance D is provided for avoiding an undesired discharge. However, the provision of distance D may narrow the discharge cells 13 (i.e., opening too narrow), resulting in a lowering of emissivity. To the contrary, a small nondischarge cell may provide a large discharge space for obtaining an increased emissivity. However, this may also tend to cause undesired discharge which in turn has an adverse effect on the adjacent discharge cell.

(c) Subject to undesired discharge: Referring to FIG. 4, there is shown two adjacent discharge regions A and a sandwiched non-discharge region B in the conventional alternating current type PDP 10. It is seen that there is no barrier between two adjacent discharge regions A. Hence, it is subject to undesired discharge in non-discharge region B.

(d) Additional processing required: Referring to FIG. 5, there is shown two adjacent discharge regions A, a sandwiched non-discharge region B, and a hatched region C. The hatched region C is where additional processing on non-discharge region is performed for blocking light emitted from non-discharge region B, thereby obtaining a strong contrast of the image shown on PDP 10.

A number of proposals regarding the structure of the barrier wall have been submitted by PDP designers and manufacturers for solving the above drawbacks. For example, Pioneer Company (Japan) discloses a waffle-like barrier wall 622 as shown in FIG. 6. The phosphor layer is respectively coated on the top, bottom, left, right, and 20 underside of the discharge cell. Hence, the coating area of the phosphor layers is increased, resulting in an increase in emissivity. Also, the discharge cell is enclosed for eliminating undesired discharge in their non-discharge region. However, such enclosed discharge cell may increase difficulty of vacuum and gas filling. Another design is disclosed by Fujitsu Company (Japan) wherein barrier wall 722 has a meander rib structure as shown in FIG. 7. Such structure can increase the coating area to a maximum. However, this design suffers from several disadvantages. For example, phosphor layer printing is difficult in the process. As a result, colors tend to mix. Further, uniformity of phosphor layer printing is not obtainable. This in turn increases manufacturing cost and difficulty. Even worse, the yield is lowered. Moreover, a back substrate manufactured by such technique does not conform to the conventional front substrate. Hence, a specifically designed front substrate is required. As to drive technique, conventional drive techniques are not applicable if a complex drive technique such as ALIS is not adopted in conjunction therewith. In brief, despite achieving a maximum coating area the design proposed by Fujitsu Company is still disadvantageous due to problems associated with manufacturing process and drive technique.

SUMMARY OF THE INVENTION

It is thus an object of the present invention to provide, in an alternating current discharge type plasma display panel (PDP), a plurality of parallel barrier walls formed on the top surface of a back substrate of the PDP, the barrier walls being disposed corresponding to cross-points of X electrodes and Y electrodes on a front substrate of the PDP. The structure comprising the plurality of discharge cells between the adjacent barrier walls has a smaller width corresponding to the X and Y electrodes for forming a large first space, a plurality of non-discharge cells each between the adjacent discharge cells forming a small second space that serves as a gas channel between the adjacent discharge cells, and a junction having a predetermined shape between one discharge cell and the adjacent non-discharge cell, so that energy released from a gas is discharge in the discharge cells is concentrated within the discharge cells for increasing discharge efficiency, and emissivity, for avoiding undesired gas discharge, and for achieving a smooth vacuum and gas filling during the manufacturing process of PDP.

The above and other objects, features and advantages of the present invention will become apparent from the following detailed description taken with the accompanying drawings.

DETAILED DESCRIPTION OF THE PREFERRED EMBODIMENTS

Figure 1:
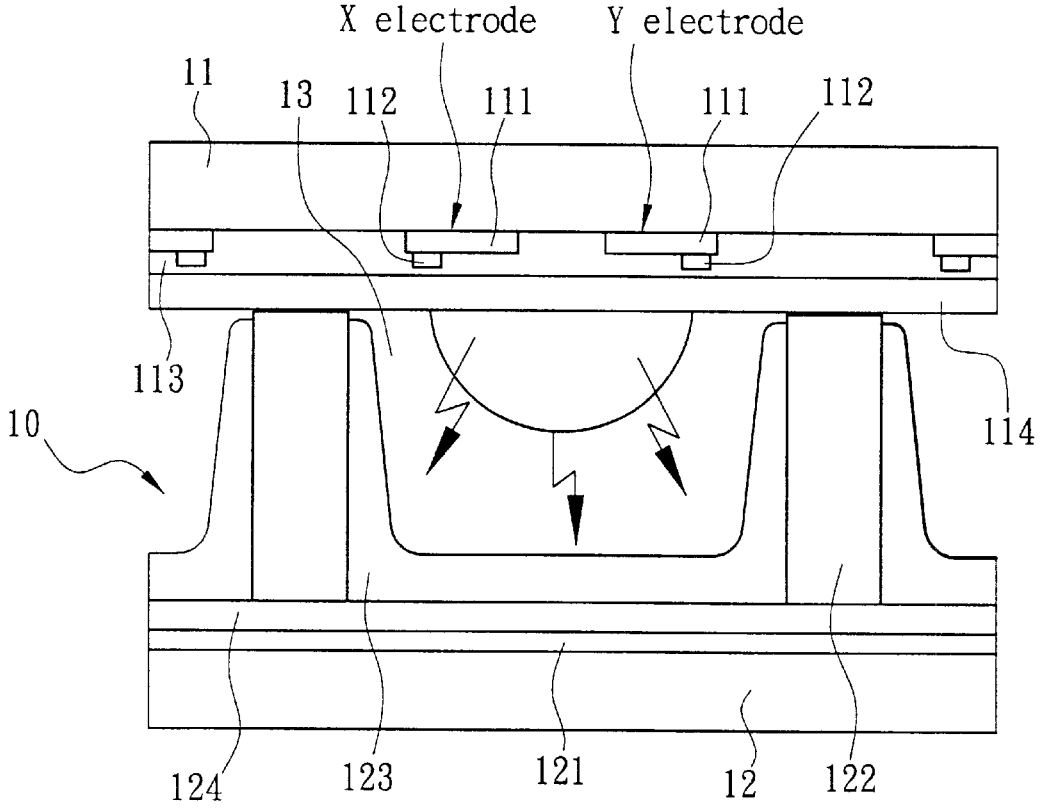
FIG. 1 (Prior Art)
FIG. 1 is a sectional view of a conventional alternating current discharge type PDP.
Figure 2:
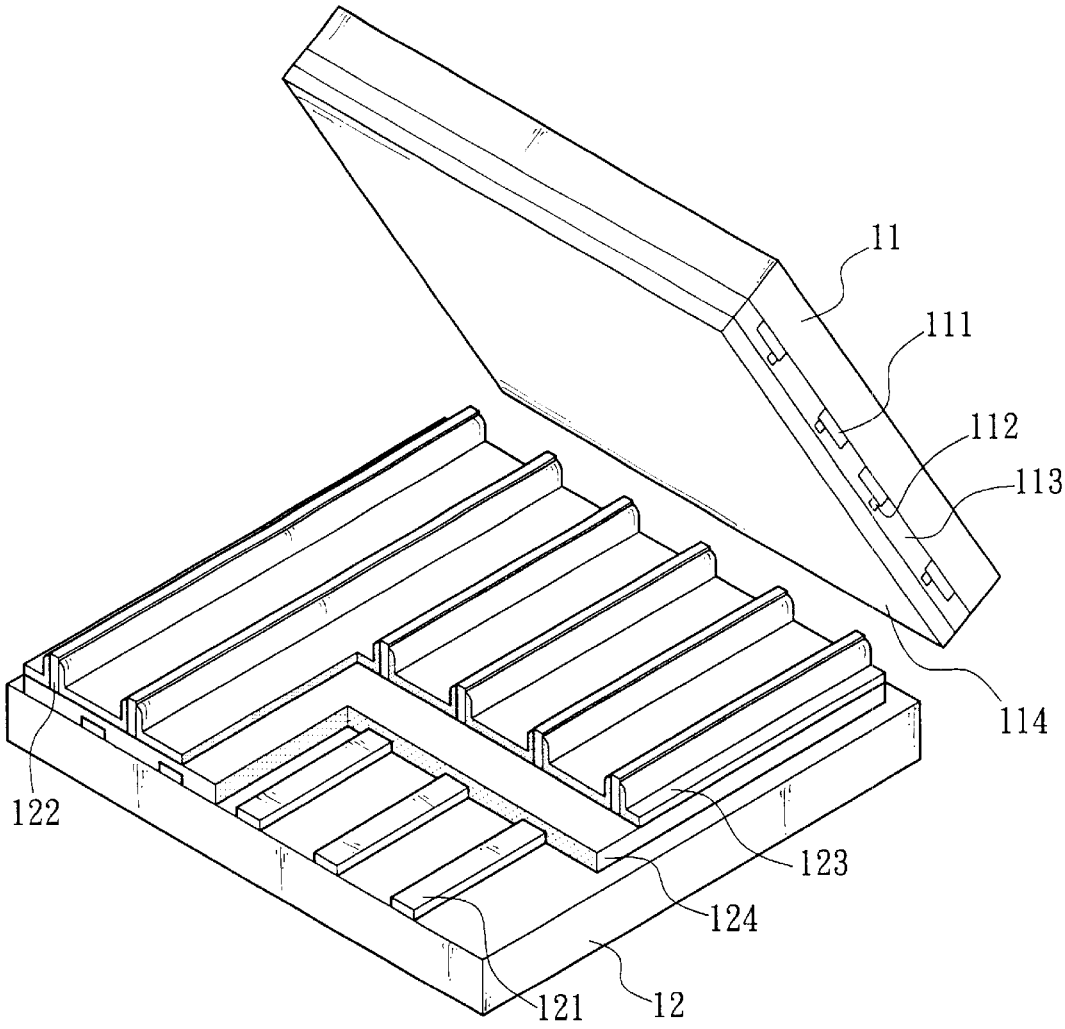
FIG. 2 (Prior Art)
FIG. 2 is a perspective view of FIG. 1 PDP.
Figure 3:
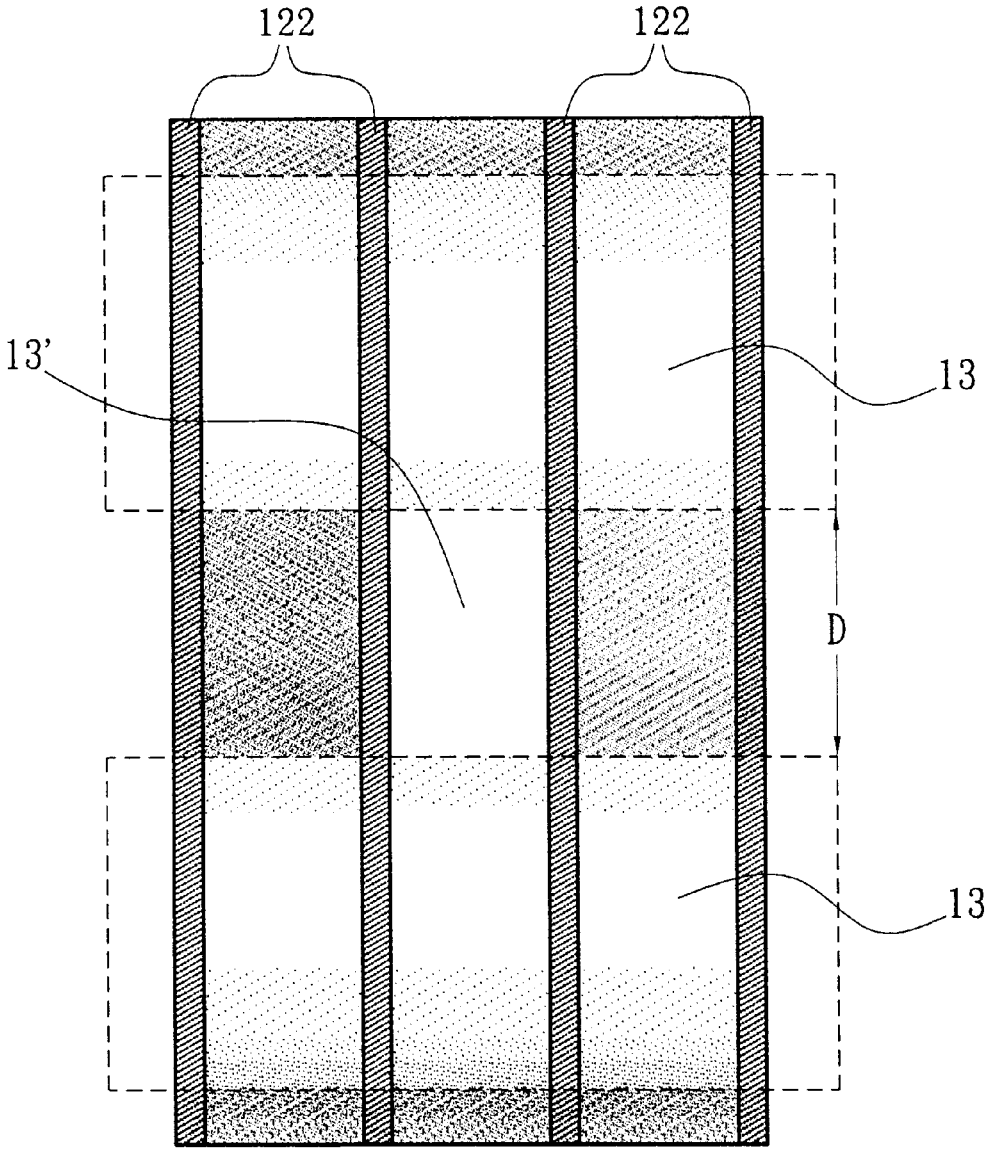
FIG. 3 (Prior Art)
FIG. 3 is sectional view showing. adjacent discharge cells of FIG. 2.
Figure 4:
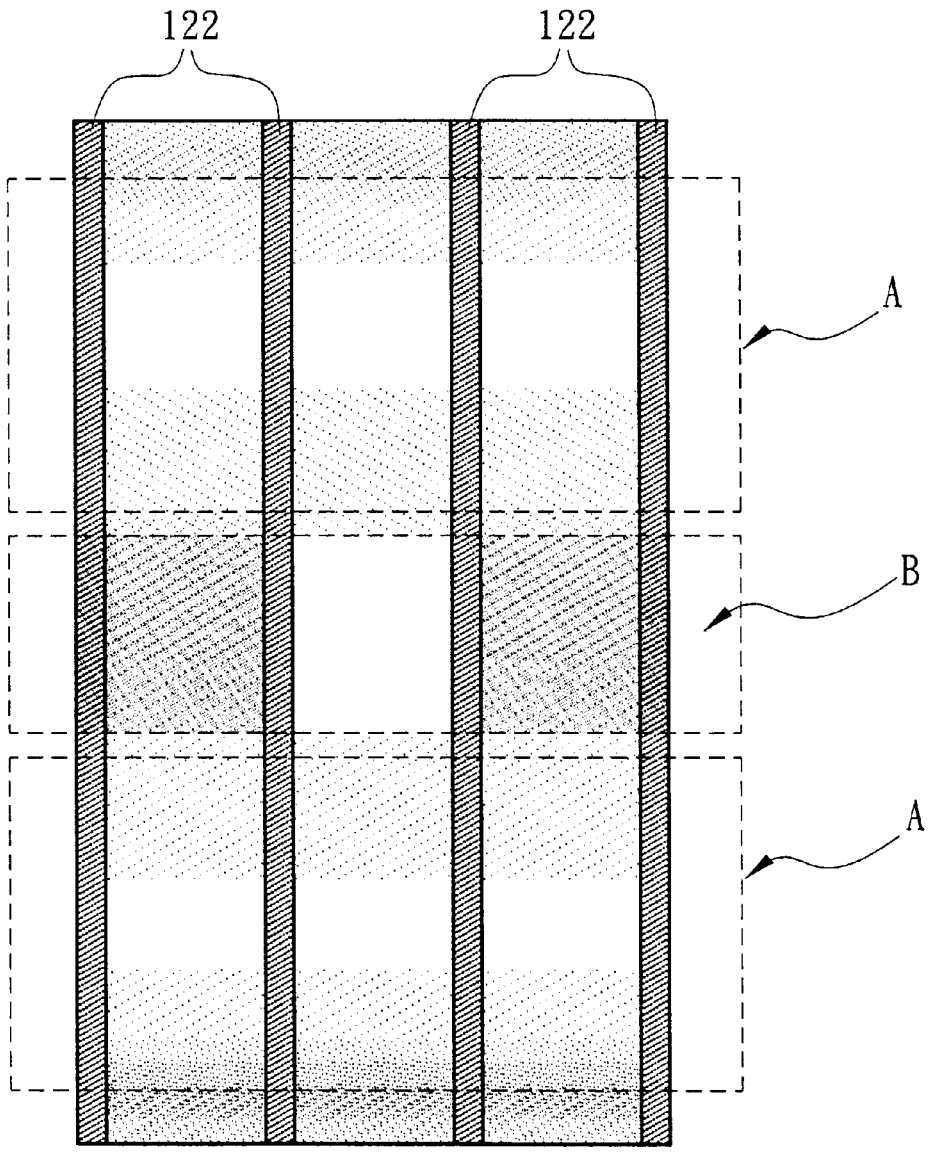
FIG. 4 (Prior Art)
FIG. 4 is a view similar to FIG. 3 showing two adjacent discharge regions, and a sandwiched non-discharge region.
Figure 5:
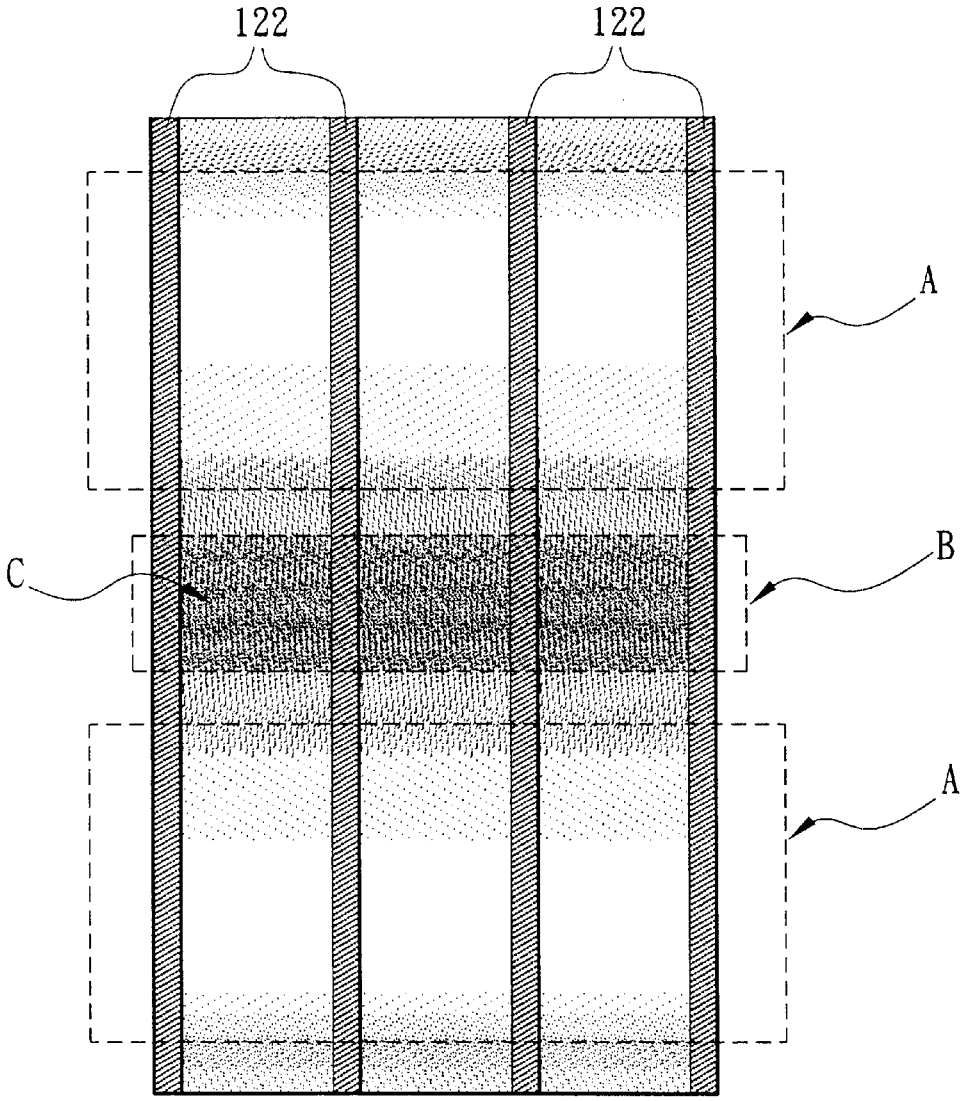
FIG. 5 (Prior Art)
FIG. 5 is a view similar to FIG. 3 showing adjacent discharge regions, a sandwiched non-discharge region, and a hatched region within non-discharge region.
Figure 6:
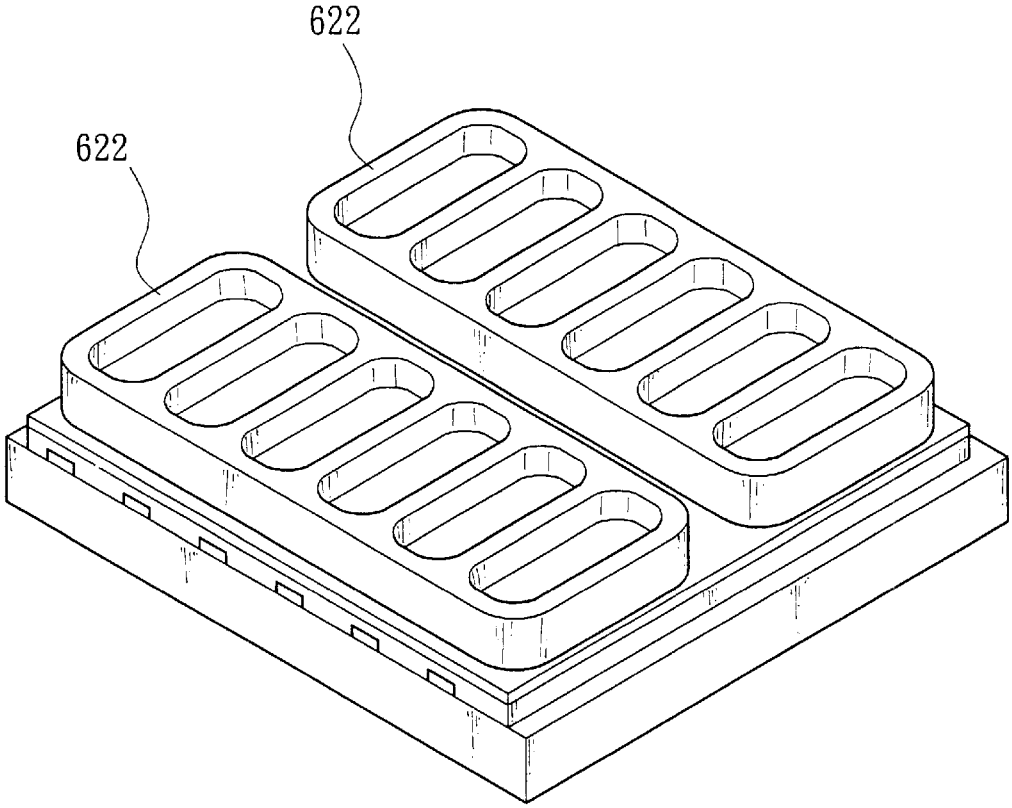
FIG. 6 (Prior Art)
FIG. 6 is a perspective view showing a waffle-like barrier wall of a conventional design.
Figure 7:
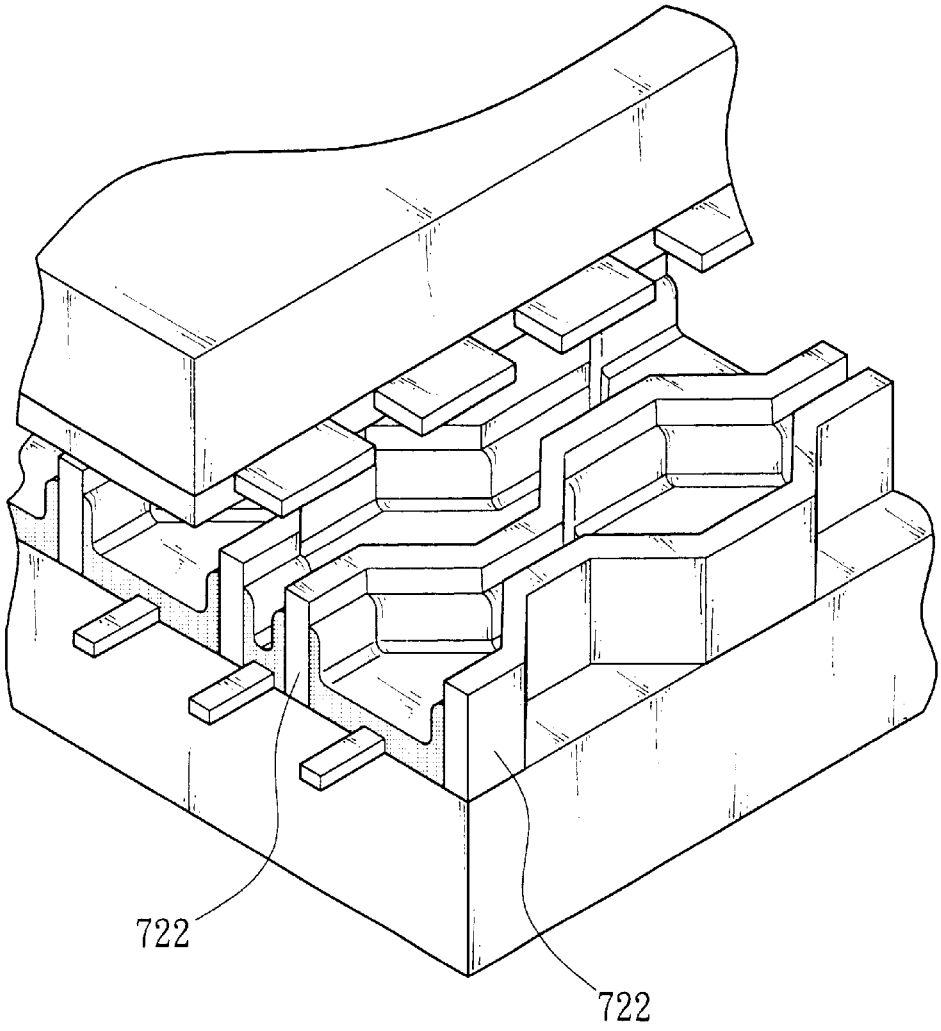
FIG. 7 (Prior Art)
FIG. 7 is a perspective view showing a meander rib-like barrier wall of another conventional design.
Figure 8A:
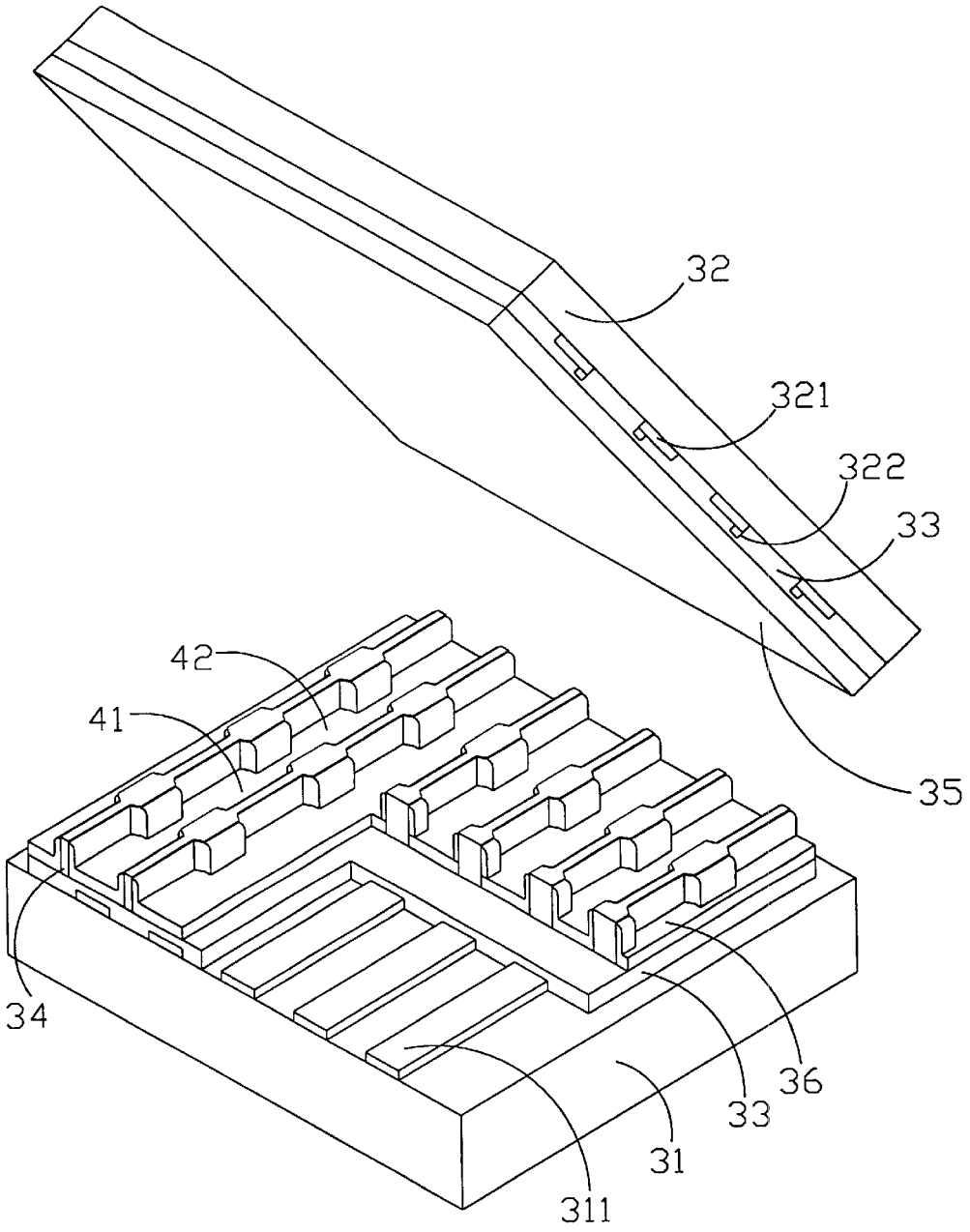
FIGS. 8A and 8B are perspective views of a back substrate and other associated elements of alternating current discharge type PDP according to the invention.
Figure 8B:
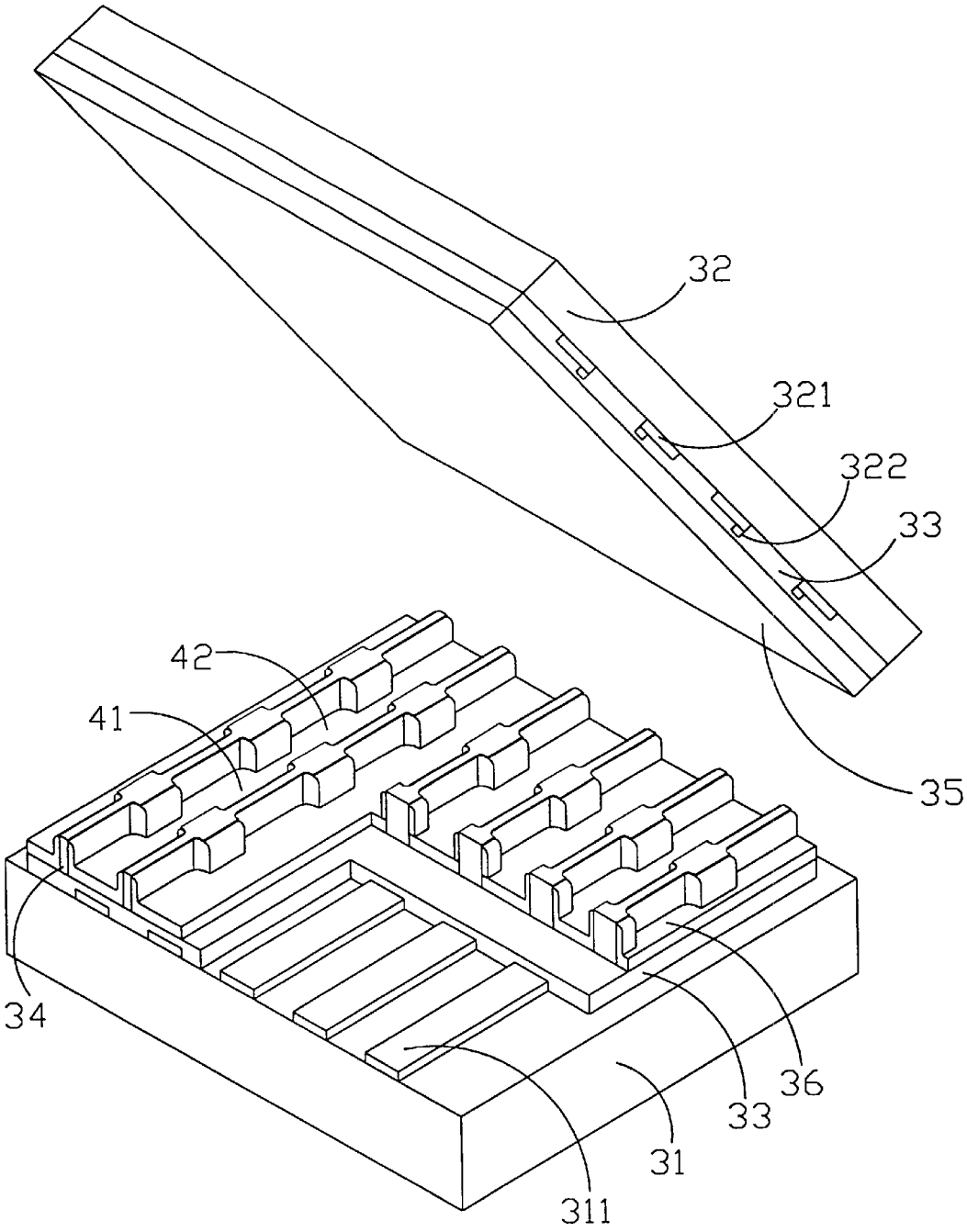

Referring to FIGS. 8A and 8B, there is shown a back substrate 31 and other associated. elements of alternating current discharge type PDP in accordance with the invention. As shown, a plurality of parallel data electrodes 311 are formed on back substrate 31. A dielectric layer 33 is formed on data electrodes 311. A plurality of parallel barrier walls 34 are formed on dielectric layer 33. Barrier walls 34 and data electrodes 311 alternate, with barrier walls 34 being positioned between data electrodes 311. On the bottom surface of front substrate 32, a plurality of parallel transparent electrodes 321 each including a bus electrode 322 (e.g., X electrode or Y electrode) are formed. A dielectric layer 33 is formed on the electrodes. A protective layer 35 is printed on dielectric layer 33. Further, back substrate and front substrate are secured together, forming a vacuum that is subsequently replaced by neon and xenon gases mixed therein. Data electrodes 311 on back substrate 31, and transparent electrodes 321 on front substrate 32 are disposed horizontally and vertically on PDP respectively. In other words, data electrodes 311 and transparent electrodes 321 are perpendicular each other, thus forming a plurality of discharge cells 41 therein.

Figure 9:
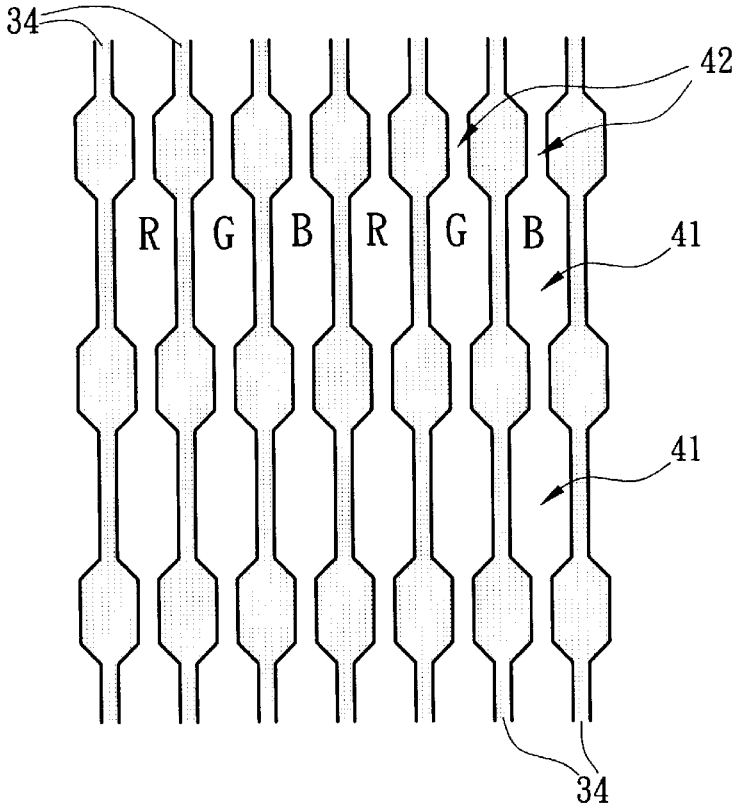
FIG. 9 is a schematic top plan view of back substrate of FIG. 8A.
Figure 10:
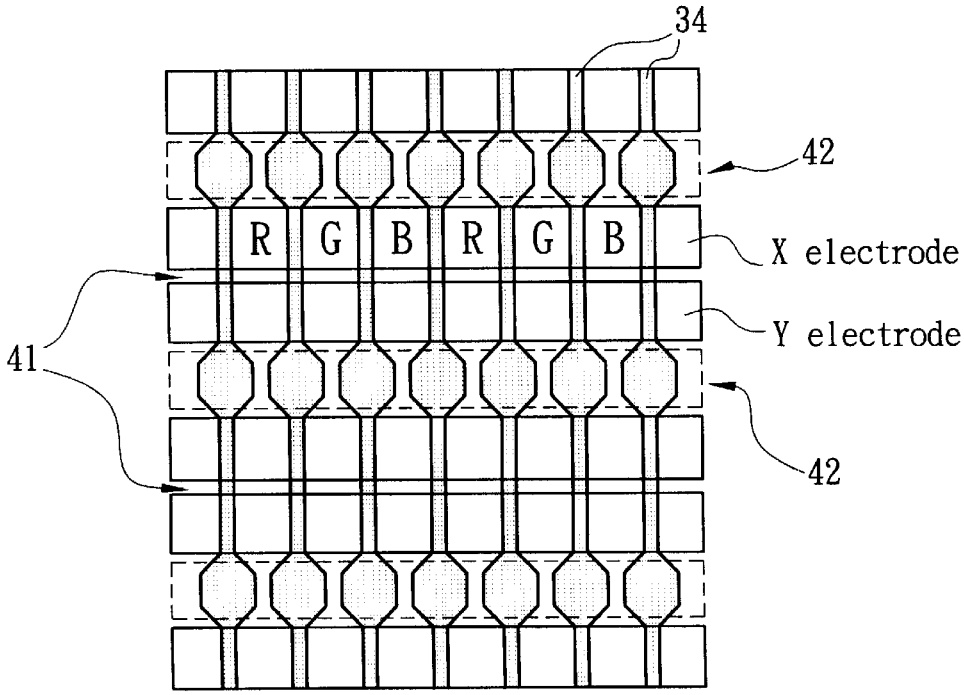
FIG. 10 is a view similar to FIG. 9 where X electrodes and Y electrodes are shown.

Referring to FIGS. 9 and 10, the configuration on top of back substrate 31 is shown. A plurality of parallel barrier walls 34 are disposed corresponding to cross-points of X electrodes and Y electrodes on front substrate 32. In detail, a plurality of discharge cells 41 are formed in wider areas between two adjacent barrier walls 34 corresponding to X electrodes and Y electrodes. Note that such wider areas (i.e., the width of barrier wall 34 is relative narrow) may increase the discharge space of discharge cells 41 and emissivity accordingly. The width of barrier wall 34 is increased from discharge cell 41 to non-discharge cell 42, i.e., the space of non-discharge cell 42 is small so as to serve as a gas channel between two adjacent discharge cells 41. This may concentrate energy released from gas discharge in discharge cells 41 for increasing discharge efficiency and emissivity, avoiding undesired gas discharge, and achieving a smooth vacuum and gas filling during the manufacturing process of PDP.

In this embodiment, the width of barrier wall 34 is relative narrow at the position abutting discharge cell 41. Further, the width of barrier wall 34 is increased in a predetermined gradient from discharge cell 41 to non-discharge cell 42, i.e., the space of non-discharge cell 42 serves as a gas channel between two adjacent discharge cells 41. Hence, it may increase opening of the discharge cell. Also, the number of surfaces with phosphor layers coated is increased from the typical three to seven. As a result, the coated area of phosphor layers is increased significantly and the emissivity of the PDP is also improved.

In one configuration of the above embodiment shown in FIG. 8A, the width of barrier wall 34 at the position abutting discharge cell 41 is increased in one of a plurality of predetermined gradients from discharge cell 41 to non-discharge cell 42, i.e., the space occupied by the non-discharge cell is small. Further, only one such non-discharge cell is reserved as a gas channel between two adjacent discharge cells 41.

In another configuration of above embodiment shown in FIG. 8B, the width of barrier wall 34 at the position abutted discharge cell 41 is increased in one of a plurality of predetermined arcs from discharge cell 41 to non-discharge cell 42, i.e., the space of non-discharge cell is small. Further, only one such non-discharge cell is reserved as a gas channel between two adjacent discharge cells 41.

As stated above, the plurality of parallel barrier walls 34 are relatively wide at the position abutting non-discharge cell 42. Hence, the structural strength of the barrier walls is greatly enhanced. In otherwords, the width of barrier wall 34 is relatively narrow at the position abutting discharge cell 41. Hence, it may increase discharge space, avoid undesired gas discharge, and increase drive voltage in operation. Further, such increase in the width of barrier wall 34 abutting non-discharge cell 42 may increase adhesion of dry photo-resist mold during sputtering because of the increase in adhesive area of the dry photo-resist mold. As a result, abnormal peeling of dry photo-resist mold is avoided during sputtering and yield is increased significantly Moreover, there is no need to alter the structure of front substrate 32 since only barrier walls 34 on back substrate 31 are modified. Hence, conventional drive technique for driving PDP are still applicable. As to printing on discharge cells 41 between adjacent barrier walls 34, the technique involved is substantially the same as that of conventional parallel barrier walls. Hence, the non-uniformity of phosphor layer printing and mixing of color as experienced in the prior art is substantially eliminated. In addition, a black or opaque material may be used to cover the barrier wall 34 abutting the non-discharge cell 42 without producing a hatched region while preserving the features of the hatched region.

As a result, yield is increased greatly and the manufacturing cost is lowered significantly.

While the invention has been described by means of specific embodiments, modifications and variations could be made thereto by those skilled in the art without departing from the scope and spirit of the invention set forth in the claims.

What is claimed is:

1. An alternating current discharge type plasma display panel (PDP) structure, comprising:

a plurality of parallel barrier walls formed on a top surface of a back substrate of said PDP, said barrier walls being disposed corresponding to cross-points of X electrodes and Y electrodes on a front substrate of said PDP;

a plurality of discharge cells between adjacent said barrier walls corresponding to said X and Y electrodes for forming a large first space;

a plurality of non-discharge cells respectively situated between adjacent said discharge cells for forming a small second space that serves as a gas channel between adjacent discharge cells, and a junction having a predetermined shape between one of the discharge cells and an adjacent one of the non-discharge cells, wherein said barrier walls adjacent said discharge cells have a smaller width than said barrier walls adjacent said non-discharge cells, and a cover of each barrier wall abutting said non-discharge cells is made of an opaque material, and whereby energy released from a gas discharge in said discharge cells is concentrated within said discharge cells.

2. The structure of claim 1, wherein said barrier wall abutting said non-discharge cell has a width that increases in a predetermined gradient from said discharge cell to said adjacent non-discharge cell so that said adjacent non-discharge cell serves as said gas channel between said adjacent discharge cells.

3. The structure of claim 1, wherein said barrier wall abutting said non-discharge cell has a width that increases in a predetermined gradient from said discharge cell to said adjacent non-discharge cell so that space occupied by said non-discharge cell is reduced and only one of said non-discharge cells serves as said gas channel between said adjacent discharge cells.

4. The structure of claim 1, wherein said barrier wall abuts said non-discharge cell and has a width that increases in at least one predetermined arc from said discharge cell to said adjacent non-discharge cell so that space occupied by said non-discharge cell is reduced and only one of said non-discharge cells serves as said gas channel between said adjacent discharge cells.

5. An alternating current discharge type plasma display panel (PDP) structure, comprising:

a plurality of parallel barrier walls formed on a top surface of a back substrate of said PDP, said barrier walls being disposed corresponding to cross-points of X electrodes and Y electrodes on a front substrate of said PDP;

a plurality of discharge cells between adjacent said barrier walls corresponding to said X and Y electrodes for forming a large first space;

a plurality of non-discharge cells respectively situated between adjacent said discharge cells for forming a small second space that serves as a gas channel between adjacent discharge cells, and a junction having a predetermined shape between one of the discharge cells and an adjacent one of the non-discharge cells, wherein said barrier walls adjacent said discharge cells have a smaller width than said barrier walls adjacent said non-discharge cells, and said barrier wall abutting said non-discharge cell has a width that increases in at least one predetermined arc from said discharge cell to said adjacent non-discharge cell so that space occupied by said non-discharge cell is reduced and only one of said non-discharge cells serves as said gas channel between said adjacent discharge cells, and whereby energy released from a gas discharge in said discharge cells is concentrated with said discharge cells.

6. The structure of claim 5, wherein a cover of each barrier wall abutting said non-discharge cells is made of an opaque material.

7. The structure of claim 5, wherein a cover of each barrier wall abutting said non-discharge cells is made of a black material.

8. An alternating current discharge type plasma display panel (PDP) structure, comprising:

a plurality of parallel barrier walls formed on a top surface of a back substrate of said PDP, said barrier walls being disposed corresponding to cross-points of X electrodes and Y electrodes on a front substrate of said PDP;

a plurality of discharge cells between adjacent said barrier walls corresponding to said X and Y electrodes for forming a large first space;

a plurality of non-discharge cells respectively situated between adjacent said discharge cells for forming a small second space that serves as a gas channel between adjacent discharge cells, and a junction having a predetermined shape between one of the discharge cells and an adjacent one of the non-discharge cells, wherein said barrier walls adjacent said discharge cells have a smaller width than said barrier walls adjacent said non-discharge cells, and a cover of each barrier wall abutting said non-discharge cells is made of a black material, and whereby energy released from a gas discharge in said discharge cells is concentrated within said discharge cells.

9. The structure of claim 8, wherein said barrier wall abutting said non-discharge cell has a width that increases in a predetermined gradient from said discharge cell to said adjacent non-discharge cell so that said adjacent non-discharge cell serves as said gas channel between said adjacent discharge cells.

10. The structure of claim 8, wherein said barrier wall abutting said non-discharge cell has a width that increases in a predetermined gradient from said discharge cell to said adjacent non-discharge cell so that space occupied by said non-discharge cell is reduced and only one of said non-discharge cells serves as said gas channel between said adjacent discharge cells.

11. The structure of claim 8, wherein said barrier wall abuts said non-discharge cell and has a width that increases in at least one predetermined arc from said discharge cell to said adjacent non-discharge cell so that space occupied by said non-discharge cell is reduced and only one of said non-discharge cells serves as said gas channel between said adjacent discharge cells.

* * * * *